US012059070B2

(12) United States Patent
Lu et al.

(10) Patent No.: US 12,059,070 B2
(45) Date of Patent: Aug. 13, 2024

(54) FLIP-FOLDING LIFT DESK

(71) Applicant: QIDONG VISION MOUNTS MANUFACTURING CO., LTD., Jiangsu (CN)

(72) Inventors: Yingchun Lu, Jiangsu (CN); Fenglei Huang, Jiangsu (CN); Hairong Lu, Jiangsu (CN)

(73) Assignee: QIDONG VISION MOUNTS MANUFACTURING CO., LTD., Jiangsu (CN)

( * ) Notice: Subject to any disclaimer, the term of this patent is extended or adjusted under 35 U.S.C. 154(b) by 144 days.

(21) Appl. No.: 17/985,826

(22) Filed: Nov. 12, 2022

(65) Prior Publication Data

US 2023/0072848 A1 Mar. 9, 2023

Related U.S. Application Data

(63) Continuation of application No. PCT/CN2021/117501, filed on Sep. 9, 2021.

(30) Foreign Application Priority Data

Dec. 1, 2020 (CN) ..... 202022835865.3
May 11, 2021 (CN) ..... 202110511203.7

(51) Int. Cl.
*A47B 3/00* (2006.01)
*A47B 9/20* (2006.01)
*A47B 13/08* (2006.01)

(52) U.S. Cl.
CPC ..... *A47B 3/002* (2013.01); *A47B 9/20* (2013.01); *A47B 13/081* (2013.01)

(58) Field of Classification Search
CPC ..... A47B 2009/003; A47B 9/10; A47B 9/20; A47B 13/081; A47B 13/023; A47B 2013/024; A47B 3/002; A47B 3/083
See application file for complete search history.

(56) References Cited

U.S. PATENT DOCUMENTS 8,661,990 B2 * 3/2014 Crowe ..... A47B 83/02 108/115
10,182,648 B1 * 1/2019 Lai ..... A47B 13/081
(Continued)

FOREIGN PATENT DOCUMENTS

CN 204169292 U 2/2015
CN 208708895 U 4/2019
(Continued)

*Primary Examiner* — Daniel J Rohrhoff
(74) *Attorney, Agent, or Firm* — SZDC Law PC

(57) ABSTRACT

A flip-folding lift desk includes: a support base, the bottom surface of the support base having at least three support members, the top surface of the support base having a connection seat extending in a direction away from the support members; a lift assembly arranged to rise and fall along its length direction, one end of the lift assembly being rotatably connected to the connection seat, so that the lift assembly can switch between two states in the length direction, including one in which the lift assembly is perpendicular to the support base, and the other in which the lift assembly is parallel to the support base; a rotation locking assembly comprising a fixed disk, a locking block, a rotating disk, a torsion spring, and a driving block; and a top assembly connected to the rotating disk on the rotation locking assembly.

15 Claims, 10 Drawing Sheets

(56) References Cited

U.S. PATENT DOCUMENTS

| | | | | |
|---|---|---|---|---|
| 10,654,315 | B1 * | 5/2020 | Kamrowski | B60B 33/0047 |
| 11,388,990 | B1 * | 7/2022 | Watkins | A63F 9/1044 |
| 2007/0095257 | A1 * | 5/2007 | Hernandez | A47B 3/0815 108/115 |
| 2019/0142153 | A1 * | 5/2019 | Zünkeler | A47B 19/06 108/13 |
| 2020/0240575 | A1 * | 7/2020 | Lee | F16M 13/022 |
| 2021/0068530 | A1 * | 3/2021 | Tao | A47B 3/0818 |
| 2021/0068531 | A1 * | 3/2021 | Tao | A47B 27/02 |
| 2022/0031064 | A1 * | 2/2022 | Supriya | A47B 9/00 |
| 2022/0053925 | A1 * | 2/2022 | Hung | A47B 23/00 |

FOREIGN PATENT DOCUMENTS

| | | | |
|---|---|---|---|
| CN | 110477599 | A | 11/2019 |
| CN | 210018295 | U | 2/2020 |
| CN | 210153478 | U | 3/2020 |
| CN | 113243667 | A | 8/2021 |

* cited by examiner

FLIP-FOLDING LIFT DESK

This application is a Continuation Application of PCT/CN2021/117501, filed on Sep. 9, 2021, which claims priority to Chinese Patent Application Nos. CN 202110511203.7, filed on May 11, 2021, and CN 202022835865.3, filed on Dec. 1, 2020, all of which are incorporated by reference for all purposes as if fully set forth herein.

TECHNICAL FIELD

The present invention relates to the technical field of office furniture, in particular to a flip-folding lift desk.

BACKGROUND

At present, with the improvement of people's living standards, the concept of healthy, happy and comfortable life is gradually popularized. Whether it is a home environment or an office environment, a desk that is comfortable and meets the needs of users has become an indispensable item in life.

In the related art, in order to realize the adjustment for people with different height and body shape, or in order to reduce the impact of prolonged sitting on the human body, a lift desk is provided. The height of the desktop can be adjusted by manually controlling the opening and closing of the lifting mechanism, so that the user can work comfortably when sitting or standing.

However, when users use the desk at home, they hope to improve the convenience of use, that is, the desk height can be adjusted when in use, and the desk can be stored in a place that does not occupy the activity space when not in use. However, the prior art lift desks often occupy a large space and cannot meet the needs of users.

The information disclosed in this background section is only intended to deepen the understanding of the overall background of the present invention, and should not be regarded as an acknowledgment or any form of suggestion that the information constitutes the prior art known to those skilled in the art.

SUMMARY

The technical problem to be solved by the present invention is to provide a flip-folding lift desk that realizes the lift-folding function and reduces the occupation of space.

To this end, the present invention provides a flip-folding desk, comprising: a support base, the bottom surface of the support base having at least three support members, the top surface of the support base having a connection seat extending in a direction away from the support members;

a lift assembly arranged to lift and lower along its length direction, one end of the lift assembly being rotatably connected to the connection seat, so that the lift assembly can switch between two states in the length direction, including one in which the lift assembly is perpendicular to the support base, and the other in which the lift assembly is parallel to the support base;

a rotation locking assembly comprising:

a fixed disk fixed at the other end of the lift assembly and having a circular cavity;

a locking block arranged in the circular cavity and movable along the radial direction of the circular cavity, the locking block having teeth at one end away from the center of the circular cavity;

a rotating disk rotatably arranged relative to the fixed disk, wherein an outer edge of the rotating disk protrudes axially and extends into the circular cavity and is provided with a ring gear corresponding to the teeth on an inner wall of the outer edge;

a torsion spring, fixed in the circular cavity and connected to the locking block, for driving the locking block to reset, so that the teeth at the end of the locking block mesh with the ring gear;

a driving block connected to the locking block and configured to, when driven by an external force, drive the locking block to disengage from the ring gear on the rotating disk to release the rotating disk from rotation restriction; and a top assembly connected to the rotating disk on the rotation locking assembly, wherein the angle of the top assembly on the horizontal plane is adjustable when the rotating disk is unlocked.

Further, the support base comprises a lateral support member and two inclined support members connected to both ends of the lateral support member, the two inclined support members being provided symmetrically along a midperpendicular of the lateral support member, and the angle between the two inclined support members and an extension line of the lateral support member being an acute angle.

Further, the support member comprises an adjustment foot disposed at the bottom of the inclined support member, the adjustment foot being threadedly connected to the bottom of the inclined support member.

Further, the support member further comprises at least one runner disposed at the bottom of the lateral support member, the runner being arranged in an axial direction parallel to the length direction of the lateral support member.

Further, the connection seat is fixed to the lateral support member, the connection seat comprising a rectangular tube arranged perpendicular to a plane in which the lateral support member is located, the rectangular tube having an opening in the direction toward the free end of the inclined support member, the opening having a dimensional accuracy meeting the requirements for rotation of the lift assembly to a horizontal state.

Further, a knob is screwed on the side wall of the rectangular tube, the top of the knob being connected to the side wall of the lift assembly to lock the rotation angle of the lift assembly.

Further, the side wall of the lift assembly is provided with a first locking hole and a second locking hole corresponding to the knob, the knob penetrating into the first locking hole when the lift assembly is in a vertical state, and the knob penetrating into the second locking hole when the lift assembly is in a horizontal state.

Further, the lift assembly comprises a gas spring provided in the vertical direction and a foot pedal hinged on the support base, the foot pedal being internally in thimble connection with the gas spring and the opening and closing of the gas spring being triggered by the pedal.

Further, the lift assembly further comprises a hollow inner column and an outer column jacketed on the inner column, one end of the gas spring being connected to the inner column and the other end being connected to the outer column.

A sliding sleeve is provided between the inner column and the outer column, the sliding sleeve having a needle roller provided thereon, the needle roller being in rolling contact with an outer wall of the inner column and with an inner wall of the outer column.

Further, the rotation locking assembly further comprises a rotating shaft fixedly connected to the driving block, the rotating shaft being rotatably provided at the axle center of the fixed disk and the rotating disk, one end of the rotating shaft protruding from the fixed disk and fixedly connected with a swing arm.

Further, the circular cavity of the fixed disk is provided with a number of protruding positioning blocks, the positioning blocks being circumferentially arranged at an even interval, with a slideway for the locking block to slide formed between every two positioning blocks.

Further, the locking block is provided with a snap groove on an end away from the teeth in the direction of its movement, and the driving block is provided with a snap hook on an end close to the snap groove, the snap hook being seated in the snap groove, so that when the driving block is moved in the direction toward the snap groove, the locking block is driven to move in the direction away from the ring gear.

Further, the snap groove extends in the direction of the width of the locking block to form a guide groove, the distance between an inner wall of the guide groove and the center of the rotating shaft being less than the distance between the outermost end of the snap hook and the center of the rotating shaft, so that when the driving block is moved in a direction away from the snap groove, the locking block is driven to move in a direction towards the ring gear.

Further, the locking blocks and the snap hooks of the driving block are uniformly distributed along the circumferential direction in a number of at least two, respectively.

Further, the top of the lift assembly is provided with a mounting plate, the mounting plate comprising a horizontal plate and two vertical plates vertically connected to both ends of the horizontal plate, the rotation locking assembly being symmetrically mounted on the outer wall of the two the vertical plates.

wherein the bottom of the top assembly is provided with a connection frame, the connection frame being arranged parallel to the vertical plates and fixedly connected to the two the rotating disks; and wherein two swing arms are provided on the inside of the two vertical plates, and a handle is connected between the two swing arms, the handle being only on the front end of the top assembly.

The beneficial effect of the present invention is that through the rotary connection between the lift assembly and the support base, the lift assembly can be vertically supported or horizontally placed, achieving the lifting function while reducing the space occupation. Through the rotary connection between the top assembly and the rotation locking assembly, the angle of the top assembly can be adjusted, which is more ergonomic and can further reduce the space occupation during folding.

DESCRIPTION OF THE DRAWINGS

In order to more clearly illustrate the embodiments of the present invention or the technical solutions in the prior art, the accompanying drawings to be used in the description of the embodiments or prior art will be briefly described below. It is obvious that the accompanying drawings in the following description are only some of the embodiments recorded in the present invention, and other accompanying drawings can be obtained according to these accompanying drawings without creative work for those of ordinary skill in the art.

DETAILED DESCRIPTION

The technical solutions in the embodiments of the present invention will be described clearly and completely in conjunction with the accompanying drawings in the embodiments of the present invention. Obviously, the described embodiments are only a part of the embodiments of the present invention, rather than all the embodiments.

It should be noted that when an element is referred to as being "fixed to" another element, it can be directly on the another element or an intermediate element may also be present. It should be noted that when an element is referred to as being "connected to" another element, it can be directly on the another element or an intermediate element may also be present. The terms "vertical", "horizontal", "left", "right" and similar expressions used herein are for illustrative purposes only and do not mean that they are the only mode of implementation.

Unless otherwise defined, all technical and scientific terms used herein have the same meaning as commonly understood by those skilled in the art of the present invention. The terms used herein are for the purpose of describing specific embodiments only and are not intended to limit the invention. The term "and/or" as used herein includes any and all combinations of one or more of the related listed items.

Figure 1:
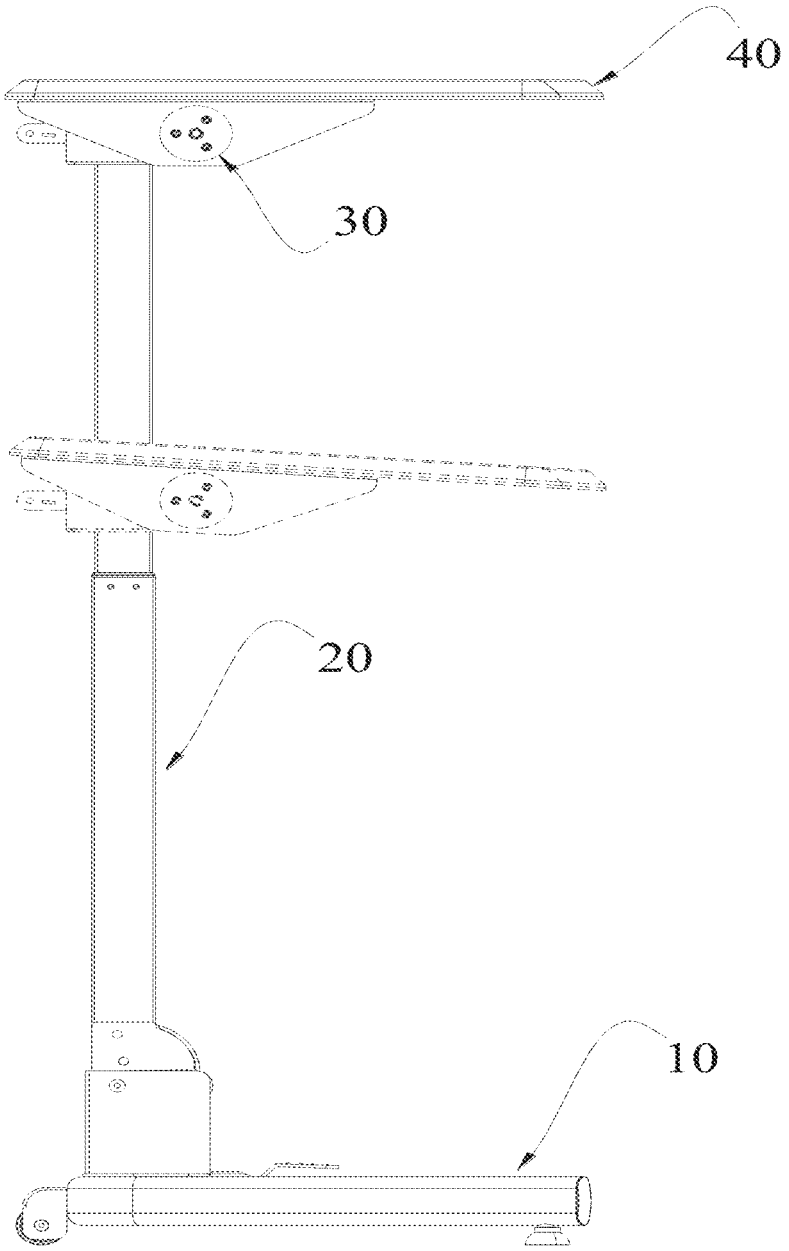
FIG. 1 is a side view of a flip-folding lift desk according to an embodiment of the present invention.
Figure 2:
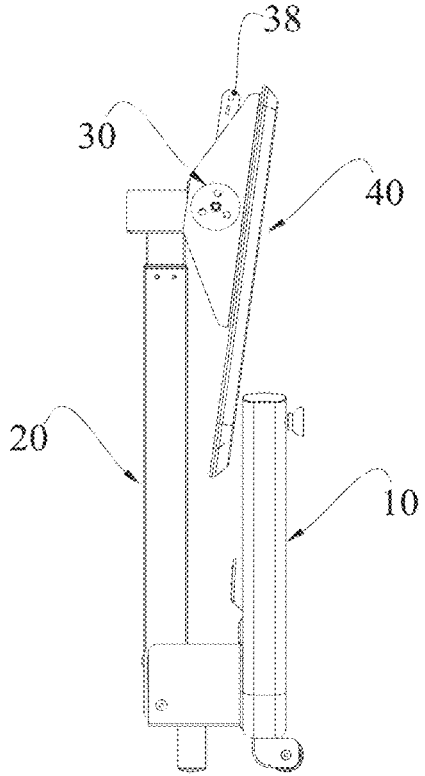
FIG. 2 is a side view of the flip-folding lift desk according to an embodiment of the present invention after folding.

As shown in FIG. 1 to FIG. 14, the flip-folding lift desk comprises a support base 10, a lift assembly 20, a rotation locking assembly 30 and a top assembly 40. As shown in FIG. 1, in normal use, the lift assembly 20 is adjusted to be perpendicular to the support base 10, and then the user works or plays games on the top assembly 40 in a standing or sitting posture, and the user can also adjust the angle of the top when standing or sitting. The desk can be folded when not in use. Specifically, first lower the lift assembly 20 to the lowest height, then fold the lift assembly 20 to be parallel to the support base 10, and then fold the top assembly 40 to form the final folded state as shown in FIG. 2. At this time, the desk can be placed against the wall, which greatly reduces the space occupation compared with the state in FIG. 1. The specific structure of the desk according to the embodiments of the present invention will be described in detail below.

Figure 5:
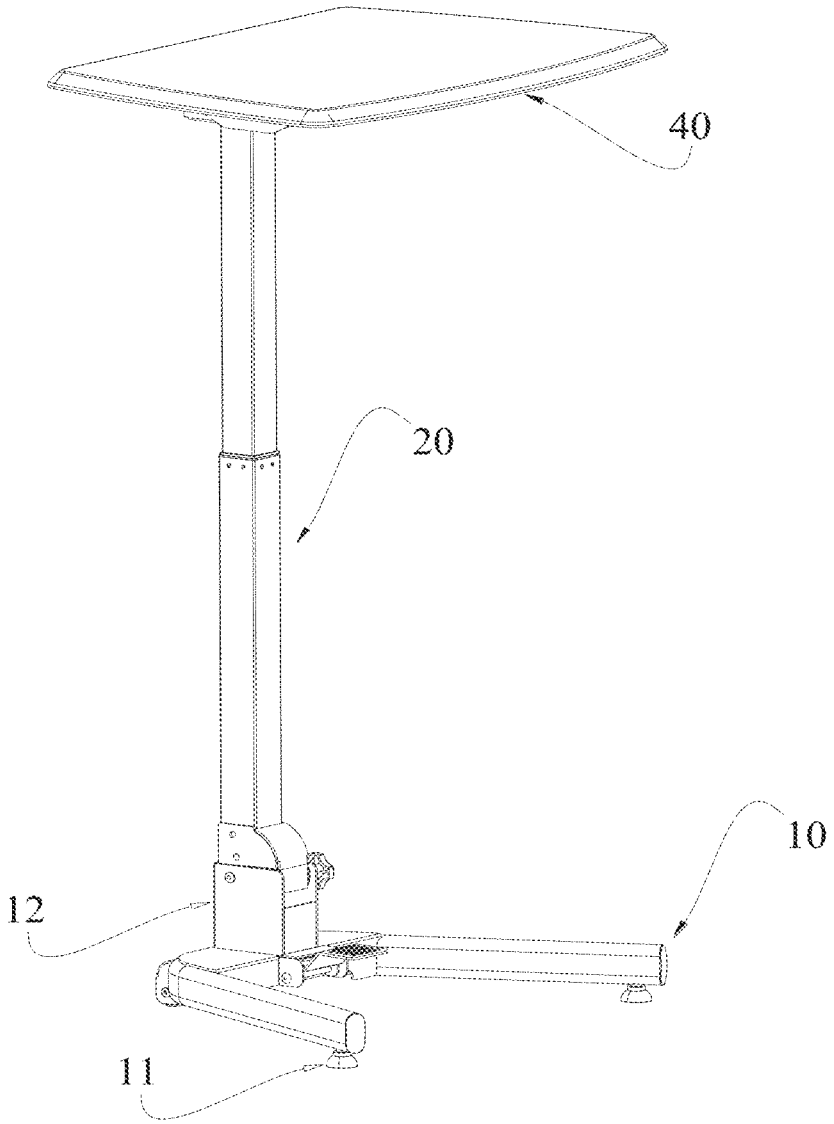
FIG. 5 is a schematic diagram of the structure of a flip-folding lift desk according to an embodiment of the present invention.

Referring to FIG. 1 or FIG. 5, the bottom surface of the support base 10 is provided with at least three support members 11, and the top surface of the support base 10 is provided with a connection seat 12 extending away from the support members 11. The function of the support members 11 is to support the entire support base 10. In use, the support base 10 is placed on a flat ground for support. At the position where the support members 11 are in contact with the ground, at least three support members 11 can form a stable support. Of course, in the embodiments of the present invention, a larger number of support members 11 can be provided. The function of the connection seat 12 is to connect with the bottom of the lift assembly 20.

The lift assembly 20 is arranged to rise and fall along its length direction, one end of the lift assembly 20 being rotatably connected to the connection seat 12, so that the lift assembly 20 can switch between two states in the length direction, including one in which the lift assembly is perpendicular to the support base 10, and the other in which the lift assembly 20 is parallel to the support base 10. The lift assembly 20 can be selected from many forms in the prior art, for example, it can be two tubular structures that fit each other, and the height can be adjusted through fasteners. Also, it can be a conventional structure that can adjust height through a pneumatic cylinder or a hydraulic cylinder. The rotatable connection between one end of the lift assembly 20 and the connection seat 12 here means that the bottom of the lift assembly 20 is hinged to the connection seat 12, and the switching between the two states can be realized by the abutting locking of the fasteners.

Figure 3:
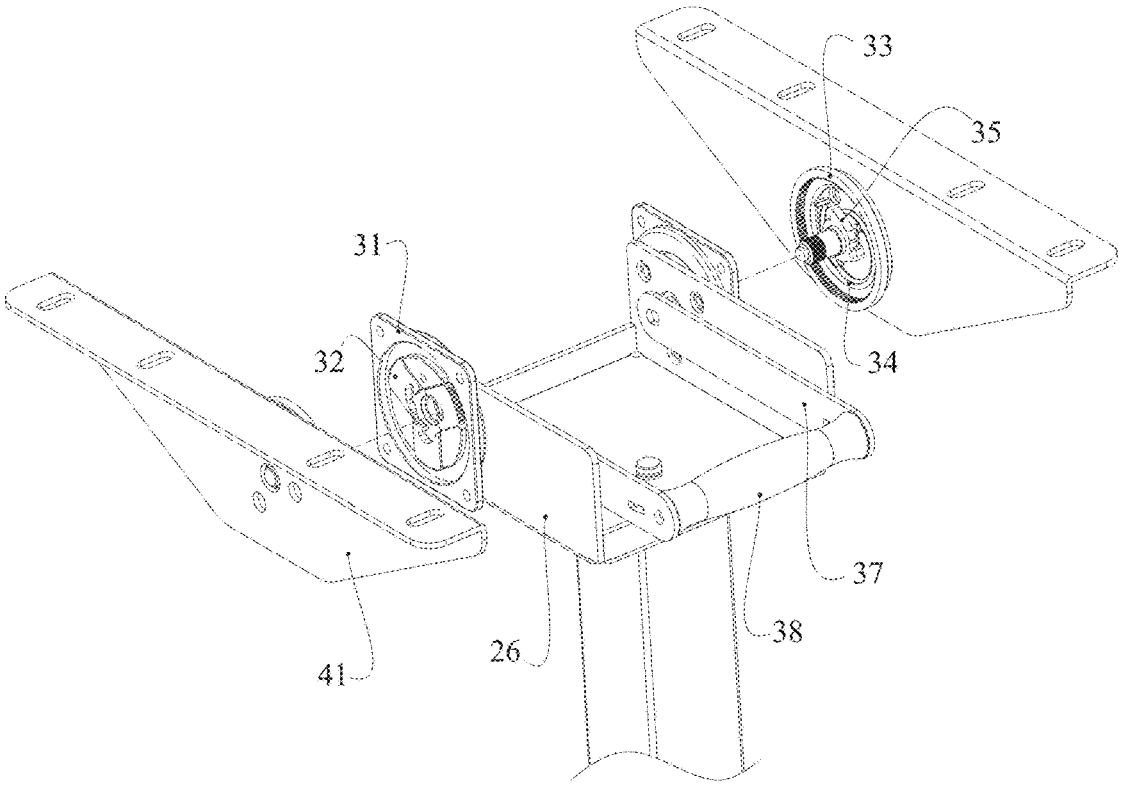
FIG. 3 is a schematic diagram of the exploded structure of the rotation locking assembly according to an embodiment of the present invention.
Figure 4:
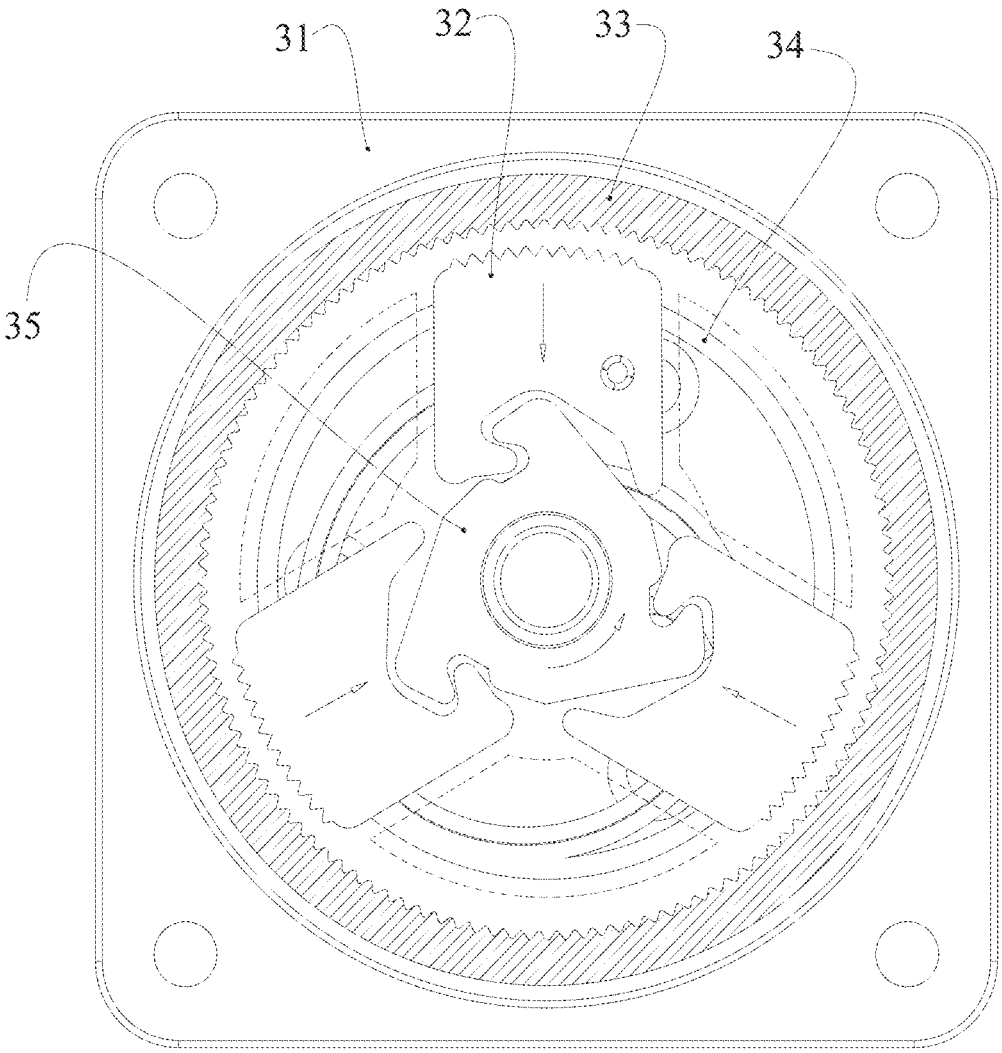
FIG. 4 is a radial sectional view of the rotation locking assembly according to an embodiment of the present invention.

The rotation locking assembly 30 connects the lift assembly 20 and the top assembly 40 for adjusting the angle of the top assembly 40. In the embodiments of the present invention, in order to reduce the occupation of space, the rotation locking assembly 30, as shown in FIG. 3 and FIG. 4, comprises a fixed disk 31, a locking block 32, a rotating disk 33, a torsion spring 34, and a driving block 35. It should be noted that the number of the rotation locking assemblies 30 used may be one, or, as in the case of the embodiments of the present invention, two. The structure of one of them will be described in detail in this embodiment first.

The fixed disk 31 is fixed on the other end of the lift assembly 20 and includes a circular cavity. In the embodiment of the present invention, the fixed disk 31 is fixed on the top of the lift assembly 20, and is fixedly connected to the lift assembly 20 through fasteners. The circular cavity is arranged on the side away from side where the fixed disk 31 is fixed.

The locking block 32 is arranged in the circular cavity and movable along the radial direction of the circular cavity, and the locking block 32 is provided with teeth at one end away from the center of the circular cavity. As shown in FIG. 3, the locking block 32 can move in a radial direction close to or away from the center of the circular cavity, and realize locking and unlocking of the rotating disk 33 through the teeth on the top thereof.

The rotating disk 33 is arranged relative to the fixed disk, wherein an outer edge of the rotating disk 33 protrudes axially and extends into the circular cavity and is provided with a ring gear corresponding to the teeth on an inner wall of the outer edge. Since the ring gear of the rotating disk 33 protrudes into the circular cavity, as shown in FIG. 4, the ring gear and the teeth on the top of the locking block 32 are in the same plane. At this time, if the locking block 32 is driven to move in the direction of the ring gear until the teeth protrude into the tooth slot of the ring gear, then the ring gear cannot rotate in the circular cavity, thus realizing the locking of the rotating disk 33. Conversely, if the locking block 32 moves away from the ring gear, the ring gear is unlocked, and the rotating disk 33 and the fixed disk 31 can rotate relative to each other.

Referring to FIG. 3 and FIG. 4, the automatic reset of the locking block 32 can be realized by means of a spring. A torsion spring 34 is fixed in the circular cavity and connected to the locking block 32 for driving the locking block 32 to reset, so that the teeth at the end of the locking block 32 mesh with the ring gear. Of course, it should be noted that the locking block 32 can be moved in a variety of ways. For example, the directional movement of the driving block 35 can be realized through a linear guide rail, and the directional movement of the driving block 35 can also be realized through a sliding groove. The reset of the locking block 32 can also be achieved by means of a torsion spring 34 or a compression spring.

The driving block 35 is connected to the locking block 32 and configured to, when driven by an external force, drive the locking block 32 to disengage from the ring gear on the rotating disk 33 to release the rotating disk 33 from rotation restriction. It should be noted that there can be various ways of external drive, for example, the movement of the locking block 32 can be realized by a button communicating with the inside of the rotating disk 33 or the fixed disk 31, or by the rotation driving in this embodiment.

The top assembly 40 is connected to the rotating disk 33 on the rotation locking assembly 30, wherein the angle of the top assembly 40 on the horizontal plane is adjustable when the rotating disk 33 is unlocked. The top assembly 40 specifically comprises a board and a member connected to the board, and will not be described in detail here.

In the above embodiment, through the rotary connection between the lift assembly 20 and the support base 10, the lift assembly 20 can be vertically supported or horizontally placed, achieving the lifting function while reducing the space occupation. Through the rotary connection between the top assembly 40 and the rotation locking assembly 30, the angle of the top assembly 40 can be adjusted, which is more ergonomic and can further reduce the space occupation during folding.

Figure 6:
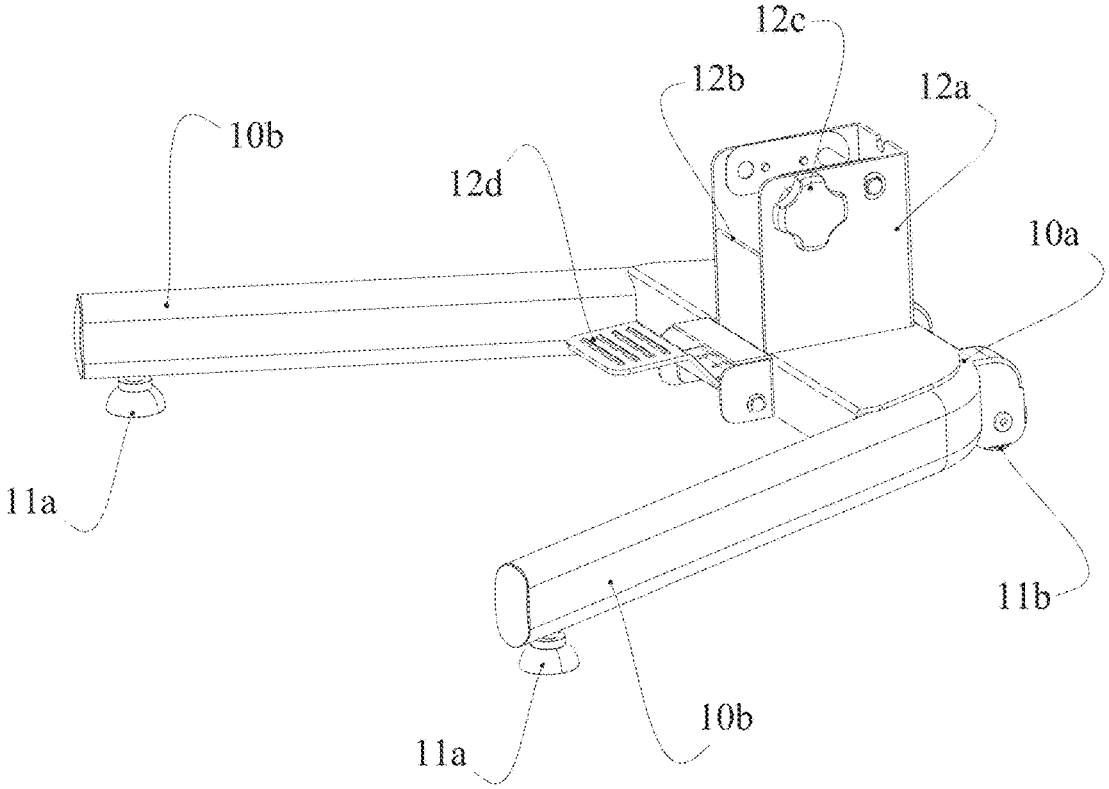
FIG. 6 is a schematic diagram of the structure of the support base according to an embodiment of the present invention.

On the basis of the above embodiment, as shown in FIG. 6, the support base 10 comprises a lateral support member **10*a* and two inclined support members 10*b* connected to both ends of the lateral support member 10*a*, the two inclined support members 10*b* being provided symmetrically along a midperpendicular of the lateral support member 10*a*, and the angle between the two inclined support members 10*b* and an extension line of the lateral support member 10*a* being an acute angle. It should be noted that the support base 10 in this embodiment is formed by bending a section steel. This structure is simple to manufacture and does not occupy floor space. In use, the area between the two inclined support members 10***b* is used for the placement of the user's feet, especially when sitting or standing, increasing the foot activity space and improving the comfort of use.

In the embodiment of the present invention, in order to improve the stability of the support base 10, as shown in FIG. 6, the support member 11 comprises an adjustment foot 11*a* disposed at the bottom of the inclined support member 10*b*, the adjustment foot 11*a* being threadedly connected to the bottom of the inclined support member 10*b*. If the ground is uneven, the height of the adjustment foot 11*a* can be adjusted by rotating the adjustment foot 11*a*, which is convenient and improves the adaptability of the desk to different placement environments. Meanwhile, in order to facilitate the position adjustment of the desk, as shown in FIG. 6, the support member 11 further comprises at least one runner 11*b* disposed at the bottom of the lateral support member 10*a*, with the axial direction of the runner 11*b* being parallel to the length direction of the lateral support member 10*a*. In a preferred embodiment of the present invention, the support member 11 is configured as two runners 11*b* disposed at the front end of the lateral support member 10*a*, and two adjustment foot 11*a* fixed at the bottom of the inclined support member 11, so as to realize the adjustment of the height and the overall movement of the desk. In use, the user only needs to lift the desk at one end of the adjustment foot 11*a* to achieve rolling contact with the ground through the runner 11*b*, thereby moving the desk conveniently.

In order to achieve precise control of the vertical or horizontal conversion of the lift assembly 20, as shown in FIG. 6, in the embodiment of the present invention, the connection seat 12 is fixed to the lateral support member 10*a*, the connection seat 12 comprises a rectangular tube 12*a* arranged perpendicular to a plane in which the lateral support member 10*a* is located, the rectangular tube 12*a* has an opening 12*b* in the direction toward the free end of the inclined support member, the opening 12*b* having a dimensional accuracy meeting the requirements for rotation of the lift assembly to a horizontal state. With this arrangement, when the lift assembly 20 is rotated toward the direction of the two inclined support members 10*b*, the lift assembly 20 can be fixed in a horizontal state of the support base 10 due to the support at the bottom of the opening 12*b*.

Further, in order to lock the horizontal or vertical state of the lift assembly 20, a knob 12*c* is screwed on the side wall of the rectangular tube 12*a*, the top of the knob 12*c* being connected to the side wall of the lift assembly 20 to lock the rotation angle of the lift assembly 20. It should be noted that the front end of the screwed knob 12*c* is a stud, and the rectangular tube 12*a* is provided with threads thereon. By rotating the knob 12*c*, the stud can enter and exit the rectangular tube 12*a*, thereby realizing fixation through abutment or perforation.

Figure 7:
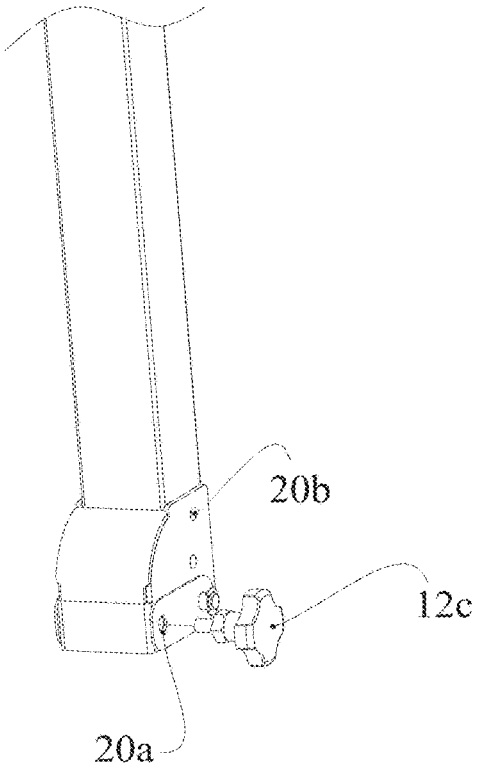
FIG. 7 is a schematic diagram of the structure of the bottom of the lift assembly according to an embodiment of the present invention.

As shown in FIG. 7, in the preferred embodiment of the present invention, the two states of the lift assembly 20 are locked by means of perforation-based fixation. The side wall of the lift assembly 20 is provided with a first locking hole 20*a* and a second locking hole 20*b* corresponding to the knob 12*c*, the knob 12*c* penetrating into the first locking hole 20*a* when the lift assembly 20 is in a vertical state, and the knob 12*c* penetrating into the second locking hole 20*b* when the lift assembly 20 is in a horizontal state. With this structural arrangement, the desk is more reliable in use, and the situation that the angle of the lift assembly 20 changes during use will not occur.

Figure 8:
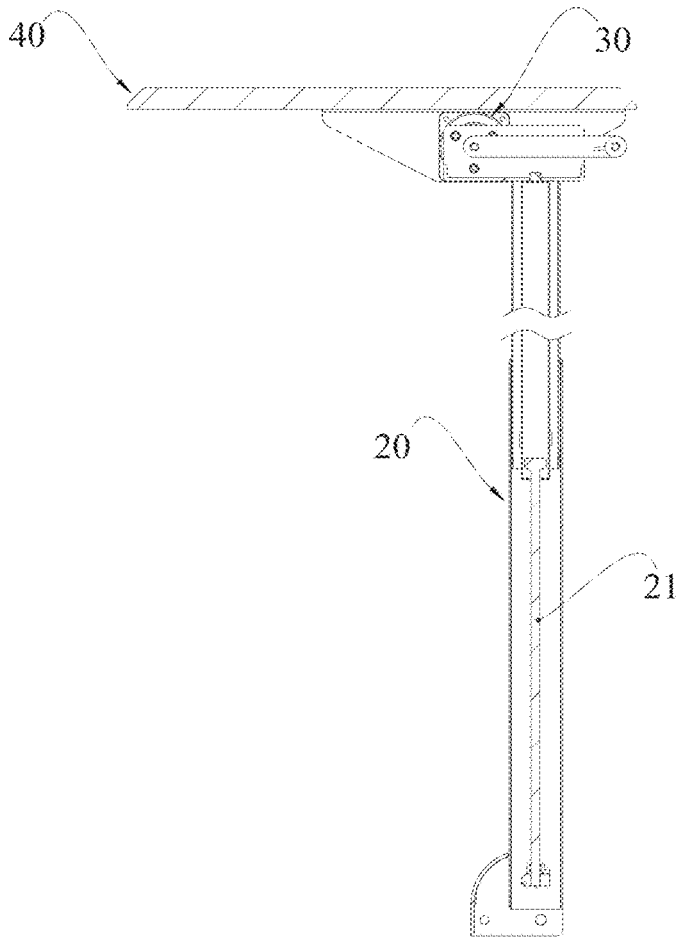
FIG. 8 is a schematic diagram of the cross-sectional structure of the top assembly and the lift assembly according to an embodiment of the present invention.

In the preferred embodiment of the present invention, regarding the driving mode of the lift assembly 20, as shown in FIG. 8 and FIG. 6, the lift assembly 20 comprises a gas spring 21 provided in the vertical direction and a foot pedal 12*d* hinged on the support base 10, the foot pedal 12*d* being in contact with the rod of the gas spring 21 and the opening and closing of the gas spring 21 being triggered by the pedal. In this way, in use, the user only needs to step on the foot pedal 12*d* to unlock the gas spring 21, and then the user lifts or presses the top assembly 40 to realize height adjustment.

Figure 9:
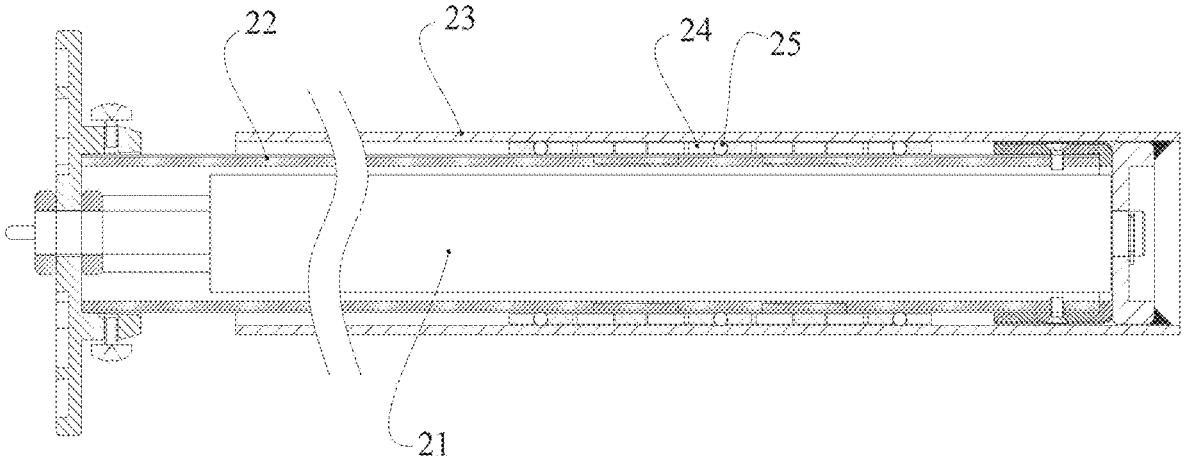
FIG. 9 is a sectional view of the lift assembly according to an embodiment of the present invention.
Figure 10:
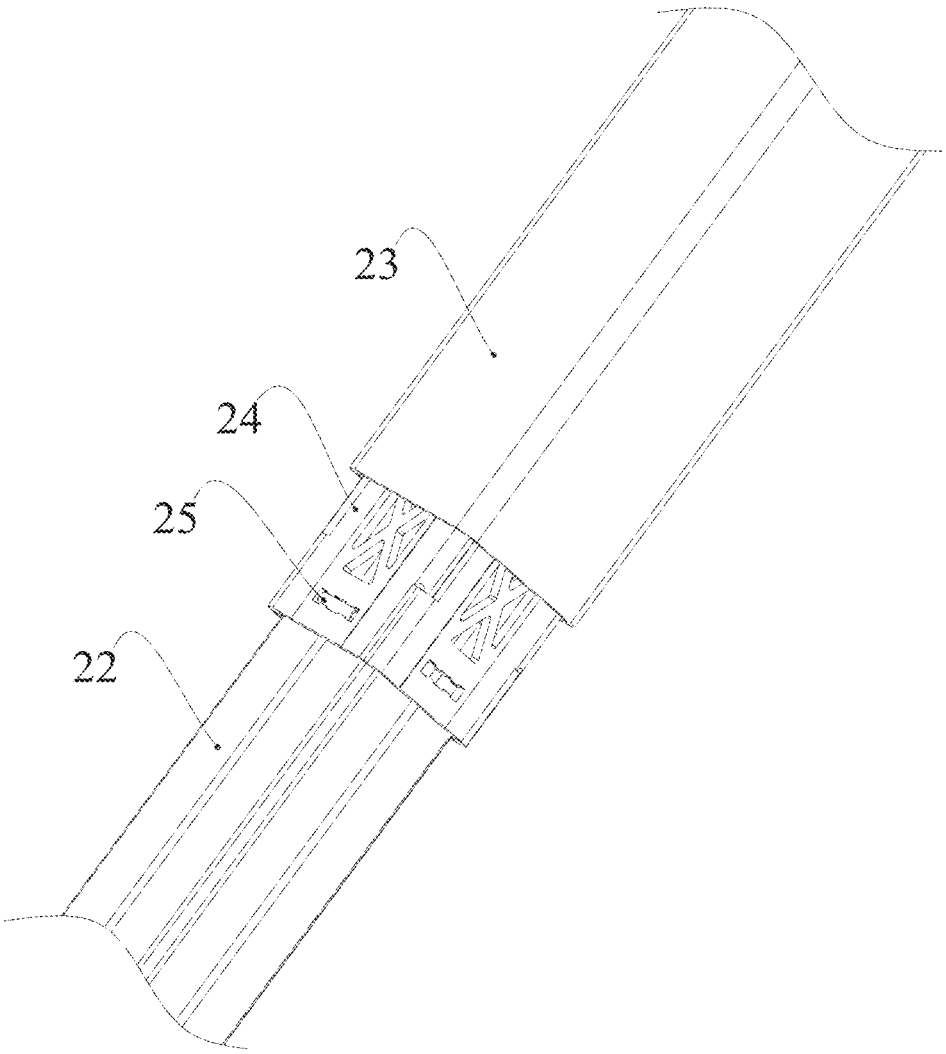
FIG. 10 is a schematic diagram of the partially exploded structure of the inner and outer columns in the lift assembly according to an embodiment of the present invention.

In the embodiment of the present invention, in order to improve the smoothness of the lift assembly 20 during adjustment and reduce noise, a double-column structure is adopted. As shown in FIG. 9 and FIG. 10, the lift assembly 20 further comprises a hollow inner column 22 and an outer column 23 jacketed on the inner column 22, one end of the gas spring 21 being connected to the inner column 22 and the other end being connected to the outer column 23. A sliding sleeve 24 is provided between the inner column 22 and the outer column 23, the sliding sleeve 24 having a needle roller 25 provided thereon, the needle roller 25 being in rolling contact with an outer wall of the inner column 22 and with an inner wall of the outer column 23. The provision of the sliding sleeve 24 reduces the gap between the inner column 22 and the outer column 23, and plays a guiding role. The provision of the needle roller 25 converts sliding friction into the rolling friction, reducing the noise and improving the sliding smoothness.

Figure 11:
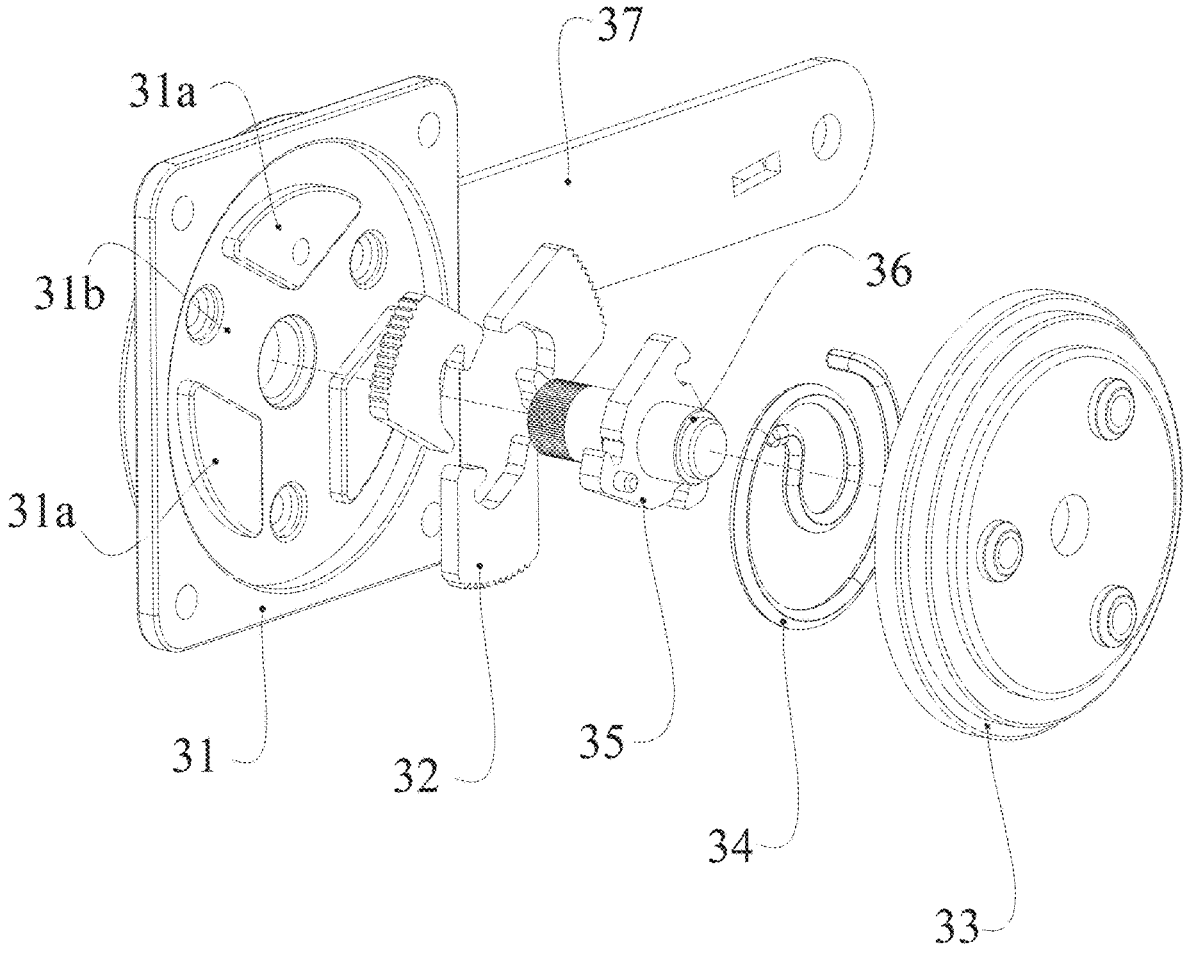
FIG. 11 is a schematic diagram of the exploded structure of the rotation locking assembly according to an embodiment of the present invention.

In the preferred embodiment of the present invention, the rotation locking assembly is unlocked by rotation. As shown in FIG. 11, the rotation locking assembly 30 further comprises a rotating shaft 36 fixedly connected to the driving block 35, the rotating shaft 36 being rotatably provided at the axle center of the fixed disk 31 and the rotating disk 33, one end of the rotating shaft 36 protruding from the fixed disk and fixedly connected with a swing arm 37. The arrangement of the rotating shaft 36 and the swing arm 37 forms a lever structure, which can reduce the magnitude of the force when the force is applied.

As shown in FIG. 11, in the preferred embodiment of the present invention, the circular cavity of the fixed disk 31 is provided with a number of protruding positioning blocks 31*a*, the positioning blocks 31*a* being circumferentially arranged at an even interval, with a slideway 31*b* for the locking block 32 to slide formed between every two positioning blocks 31*a*. In this way, the space occupation can be reduced.

Figure 12:
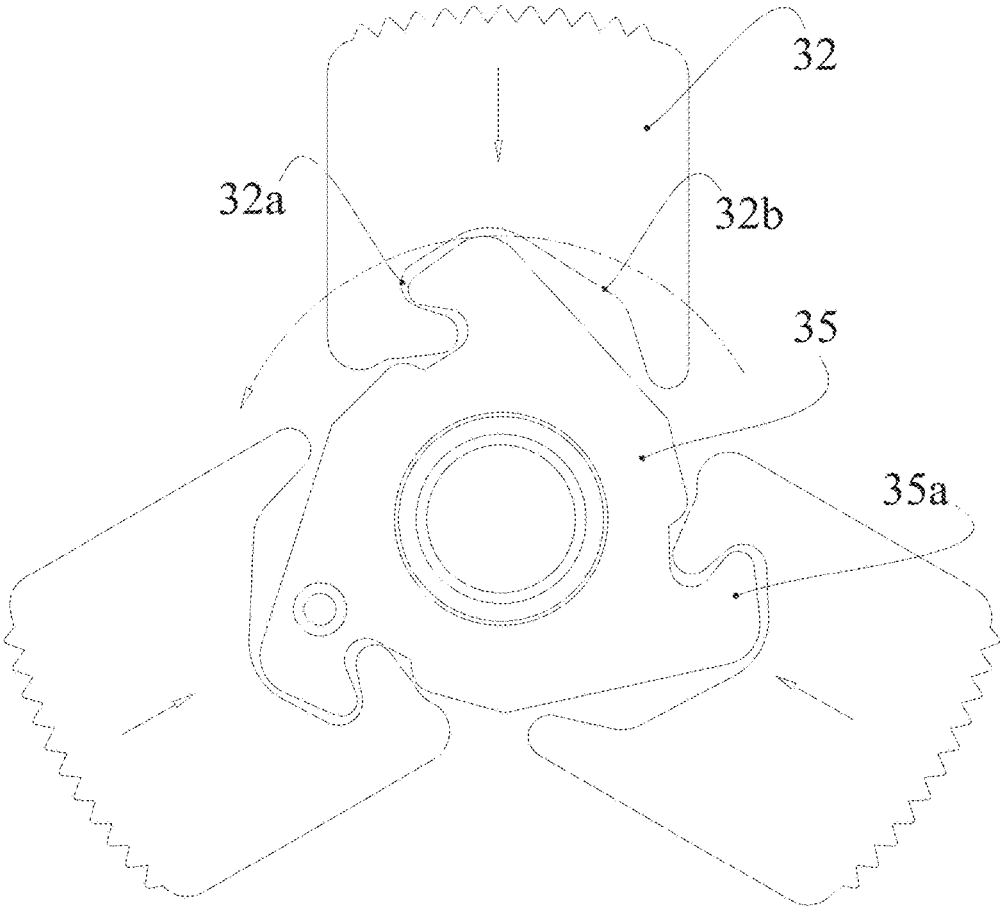
FIG. 12 is a schematic diagram of the driving principle of the locking block and the driving block according to an embodiment of the present invention.

Regarding the rotation drive, specifically as shown in FIG. 12, the locking block 32 is provided with a snap groove on an end away from the teeth in the direction of its movement, the driving block 35 is provided with a snap hook on an end close to the snap groove, the snap hook being seated in the snap groove, so that when the driving block 35 is moved in the direction toward the snap groove, the locking block 32 is driven to move in the direction away from the ring gear. As shown in FIG. 12, when the driving block 35 is rotated counterclockwise, a driving force is generated in the radial direction to drive the locking block 32 toward the center because the snap hook is connected to the snap groove.

In the embodiment of the present invention, in addition to using the torsion spring 34, locking can also be achieved by rotating the driving block 35 in the reverse direction. As show in FIG. 12, the snap groove extends in the direction of the width of the locking block 32 to form a guide groove, the distance between an inner wall of the guide groove and the center of the rotating shaft 36 being less than the distance between the outermost end of the snap hook and the center of the rotating shaft 36, so that when the driving block 35 is moved in a direction away from the snap groove, the locking block 32 is driven to move in a direction towards the ring gear. It should be noted here that in the embodiment of the present invention, one end of the torsion spring 34 is fixed on the rotating disk 33 and the other end is connected to the driving block 35, so that after the driving block 35 is driven by an external force, automatic reverse rotation locking can be realized by the elastic force of the torsion spring 34.

In order to realize the force balance and ensure the locking effect, in the embodiment of the present invention, the locking blocks and the snap hooks of the driving block are uniformly distributed along the circumferential direction in a number of at least two, respectively. As shown in FIG. 4 and FIG. 12, in the preferred embodiment of the present invention, three locking blocks 32 are uniformly arranged in the circumferential direction, and three snap hooks are provided on the same driving block 35. In this way, by driving the same rotating shaft 36, the synchronous driving of the three locking blocks 32 can be realized, improving the driving reliability.

Figure 13:
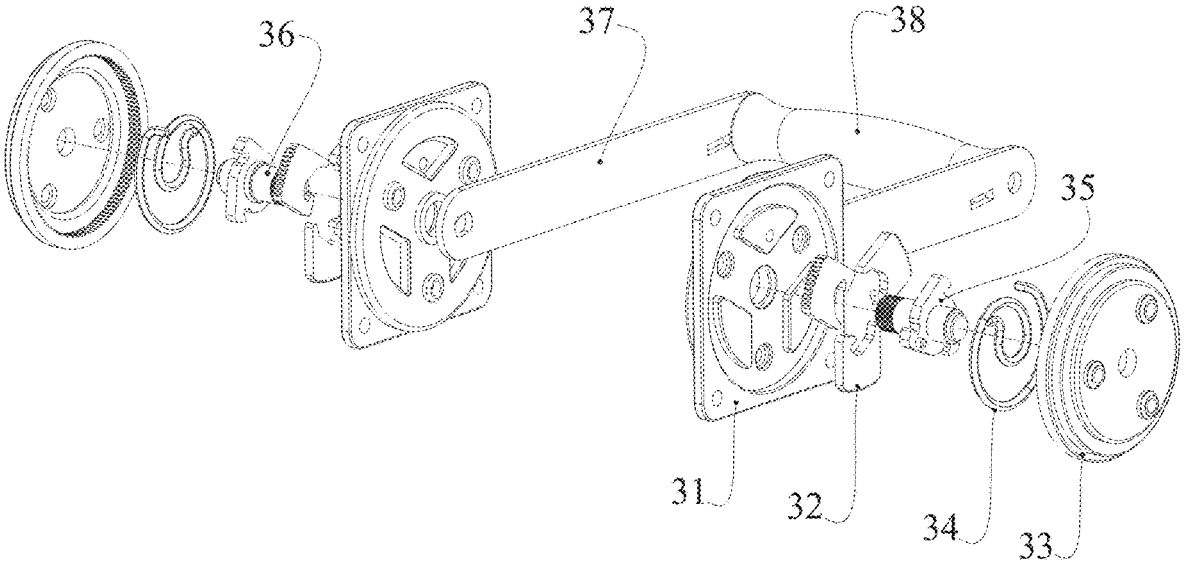
FIG. 13 is a schematic diagram of the overall exploded structure of the rotation locking assembly according to an embodiment of the present invention.
Figure 14:
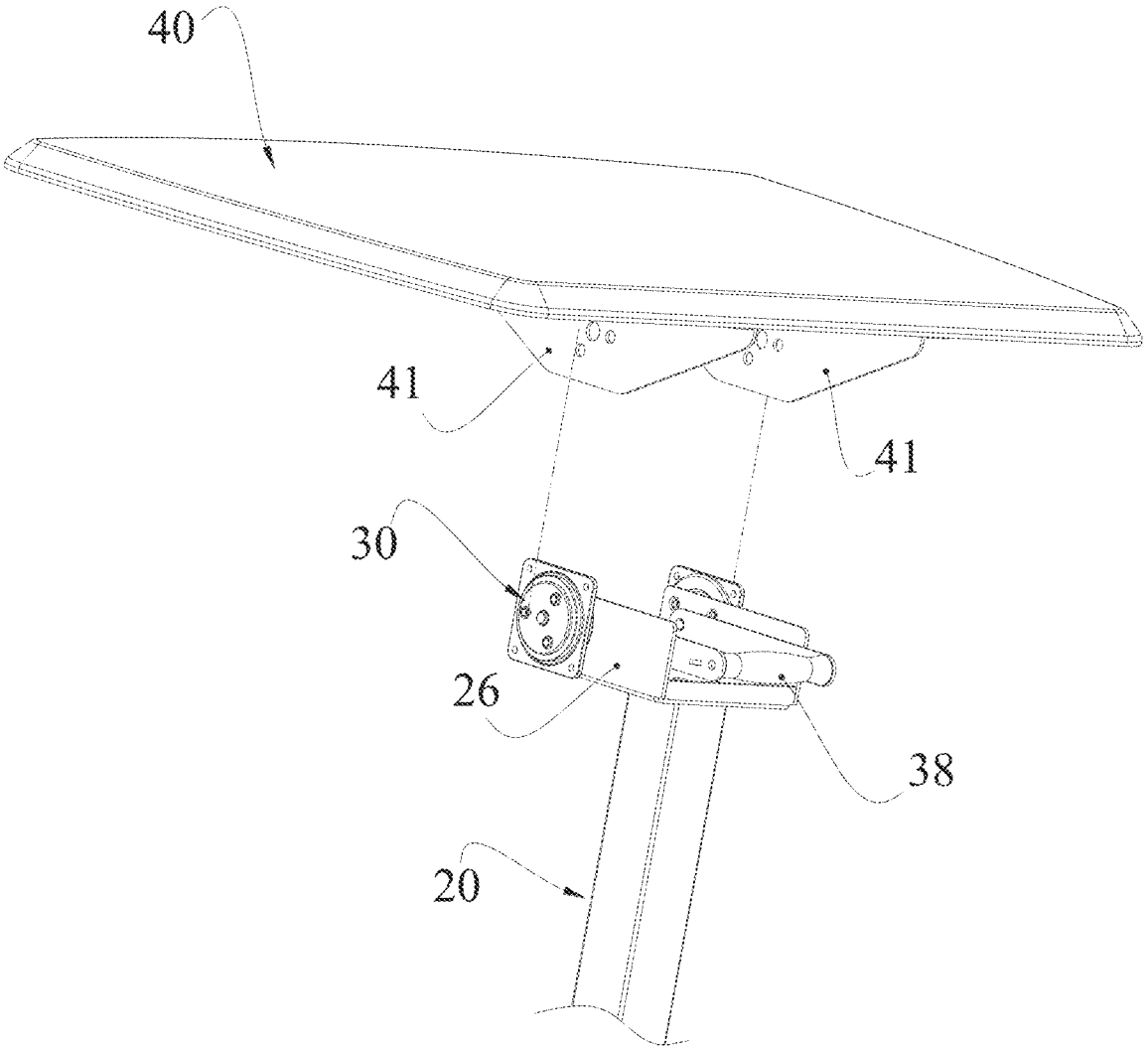
FIG. 14 is a schematic diagram of the exploded structure of the top assembly, the rotation locking assembly and the lift assembly according to an embodiment of the present invention.

As shown in FIG. 3 and FIG. 14, the top of the lift assembly 20 is provided with a mounting plate 26, the mounting plate 26 comprising a horizontal plate and two vertical plates vertically connected to both ends of the horizontal plate, the rotation locking assembly 30 being symmetrically mounted on the outer wall of the two the vertical plates. The locking effect can be improved by arranging the rotation locking assembly 30 symmetrically on the outer walls of the two vertical plates. The bottom of the top assembly 40 is provided with a connection frame 41, the connection frame 41 being arranged parallel to the vertical plate and fixedly connected to the two the rotating disks 33. In this way, the connection frame 41, the board and the mounting plate 26 constitute a channel for receiving the swing arm 37. In order to control the two swing arms 37 at the same time, in the embodiment of the present invention, as shown in FIG. 13, the two swing arms 37 are arranged inside the two vertical plates, and a handle 38 is connected between the two swing arms 37, the handle 38 being only at the front end of the top assembly 40. In this way, during specific operation, the angle of the desk can be adjusted only by lifting the handle 38. Moreover, as shown in FIG. 2, when the desk is folded, one end of the desk top assembly 40 is clamped inside the support base 10, and the handle 38 is set facing outward. When the entire desk needs to be lifted, it is only necessary to lift the handle 38, which facilitates the movement of the desk in the folded state.

Those skilled in the industry should understand that the present invention is not limited by the foregoing embodiments. The foregoing embodiments and descriptions only illustrate the principles of the present invention. Without departing from the spirit and scope of the present invention, the present invention will have various changes and improvements, which fall within the scope of the claimed invention. The scope of protection claimed by the present invention is defined by the appended claims and their equivalents.

The invention claimed is:

1. A flip-folding lift desk, comprising:

a support base, the bottom surface of the support base having at least three support members, and the top surface of the support base having a connection seat extending in a direction away from the support members;

a lift assembly arranged to rise and fall along its length direction, one end of the lift assembly being rotatably connected to the connection seat, so that the lift assembly can switch between two states in the length direction, including one in which the lift assembly is perpendicular to the support base, and the other in which the lift assembly is parallel to the support base;

a rotation locking assembly comprising:

a fixed disk fixed at the other end of the lift assembly and having a circular cavity;

a locking block arranged in the circular cavity and movable along the radial direction of the circular cavity, the locking block having teeth at one end away from the center of the circular cavity;

a rotating disk rotatably arranged relative to the fixed disk, wherein an outer edge of the rotating disk protrudes axially and extends into the circular cavity and is provided with a ring gear corresponding to the teeth on an inner wall of the outer edge;

a torsion spring, fixed in the circular cavity and connected to the locking block, for driving the locking block to reset, so that the teeth at the end of the locking block mesh with the ring gear;

a driving block connected to the locking block and configured to, when driven by an external force, drive the locking block to disengage from the ring gear on the rotating disk to release the rotating disk from rotation restriction; and a top assembly connected to the rotating disk on the rotation locking assembly, wherein the angle of the top assembly on the horizontal plane is adjustable when the rotating disk is unlocked.

2. The flip-folding lift desk according to claim 1, wherein the support base comprises a lateral support member and two inclined support members connected to both ends of the lateral support member, the two inclined support members being provided symmetrically along a midperpendicular of the lateral support member, and the angle between the two inclined support members and an extension line of the lateral support member being an acute angle.

3. The flip-folding lift desk according to claim 2, wherein the support member comprises an adjustment foot disposed at the bottom of the inclined support member, the adjustment foot being threadedly connected to the bottom of the inclined support member.

4. The flip-folding lift desk according to claim 2, wherein the support member further comprises at least one runner disposed at the bottom of the lateral support member, with the axial direction of the runner being parallel to the length direction of the lateral support member.

5. The flip-folding lift desk according to claim 2, wherein the connection seat is fixed to the lateral support member, the connection seat comprising a rectangular tube arranged perpendicular to a plane in which the lateral support member is located, the rectangular tube having an opening in the direction toward the free end of the inclined support member, the opening being adapted for rotation of the lift assembly to a horizontal state.

6. The flip-folding lift desk according to claim 5, wherein a knob is screwed on the side wall of the rectangular tube, the top of the knob being connected to the side wall of the lift assembly to lock the rotation angle of the lift assembly.

7. The flip-folding lift desk according to claim 6, wherein the side wall of the lift assembly is provided with a first locking hole and a second locking hole corresponding to the knob, the knob penetrating into the first locking hole when the lift assembly is in a vertical state, and the knob penetrating into the second locking hole when the lift assembly is in a horizontal state.

8. The flip-folding lift desk according to claim 1, wherein the lift assembly comprises a gas spring provided in the vertical direction and a foot pedal hinged on the support base, the foot pedal being in contact with a rod of the gas spring and the opening and closing of the gas spring being triggered by the pedal.

9. The flip-folding lift desk according to claim 8, wherein the lift assembly further comprises a hollow inner column and an outer column jacketed on the inner column, one end of the gas spring being connected to the inner column and the other end being connected to the outer column; and wherein a sliding sleeve is provided between the inner column and the outer column, the sliding sleeve having a needle roller provided thereon, the needle roller being in rolling contact with an outer wall of the inner column and with an inner wall of the outer column.

10. The flip-folding lift desk according to claim 1, wherein the rotation locking assembly further comprises a rotating shaft fixedly connected to the driving block, the rotating shaft being rotatably provided at the axle center of the fixed disk and the rotating disk, one end of the rotating shaft protruding from the fixed disk and fixedly connected with a swing arm.

11. The flip-folding lift desk according to claim 10, wherein the circular cavity of the fixed disk is provided with a number of protruding positioning blocks, the positioning blocks being circumferentially arranged at an even interval, with a slideway for the locking block to slide formed between every two positioning blocks.

12. The flip-folding lift desk according to claim 10, wherein the locking block is provided with a snap groove on an end away from the teeth in the direction of its movement, and the driving block is provided with a snap hook on an end close to the snap groove, the snap hook being seated in the snap groove, so that when the driving block is moved in the direction toward the snap groove, the locking block is driven to move in the direction away from the ring gear.

13. The flip-folding lift desk according to claim 12, wherein the snap groove extends in the direction of the width of the locking block to form a guide groove, the distance between an inner wall of the guide groove and the center of the rotating shaft being less than the distance between the outermost end of the snap hook and the center of the rotating shaft, so that when the driving block is moved in a direction away from the snap groove, the locking block is driven to move in a direction towards the ring gear.

14. The flip-folding lift desk according to claim 13, wherein the locking blocks and the snap hooks of the driving block are uniformly distributed along the circumferential direction in a number of at least two, respectively.

15. The flip-folding lift desk according to claim 14, wherein the top of the lift assembly is provided with a mounting plate, the mounting plate comprising a horizontal plate and two vertical plates vertically connected to both ends of the horizontal plate, the rotation locking assembly being symmetrically mounted on the outer wall of the two the vertical plates;

wherein the bottom of the top assembly is provided with a connection frame, the connection frame being arranged parallel to the vertical plates and fixedly connected to the two the rotating disks; and wherein two swing arms are provided on the inside of the two vertical plates, and a handle is connected between the two swing arms, the handle being only at the front end of the top assembly.

* * * * *